US008100701B2

(12) United States Patent
Gerber et al.

(10) Patent No.: US 8,100,701 B2
(45) Date of Patent: Jan. 24, 2012

(54) ADAPTER AND PLUG-IN CONNECTION SYSTEM

(75) Inventors: Matthias Gerber, Ruti (CH); Michael Keiser, Uster (CH)

(73) Assignee: Reichle & De-Massari AG, Wetzikon (CH)

( * ) Notice: Subject to any disclaimer, the term of this patent is extended or adjusted under 35 U.S.C. 154(b) by 0 days.

(21) Appl. No.: 12/438,482

(22) PCT Filed: Aug. 23, 2007

(86) PCT No.: PCT/CH2007/000416

§ 371 (c)(1),
(2), (4) Date: Mar. 27, 2009

(87) PCT Pub. No.: WO2008/025180

PCT Pub. Date: Mar. 6, 2008

(65) Prior Publication Data

US 2010/0015858 A1 Jan. 21, 2010

(30) Foreign Application Priority Data

Sep. 1, 2006 (CH) ..... 1403/06

(51) Int. Cl.
*H01R 12/00* (2006.01)

(52) U.S. Cl. ..... 439/77

(58) Field of Classification Search ..... 439/77, 439/676, 540.1, 660, 638
See application file for complete search history.

(56) References Cited

U.S. PATENT DOCUMENTS

| | | | | |
|---|---|---|---|---|
| 4,241,974 | A * | 12/1980 | Hardesty | 439/638 |
| 4,438,998 | A * | 3/1984 | Myers | 439/638 |
| 4,784,615 | A * | 11/1988 | Teng-Hong | 439/496 |
| 5,015,197 | A | 5/1991 | Redmond et al. | |
| 5,562,493 | A | 10/1996 | Ferrill et al. | |
| 5,651,690 | A * | 7/1997 | Klas et al. | 439/352 |
| 5,984,731 | A | 11/1999 | Laity | |
| 6,146,153 | A | 11/2000 | Koradia et al. | |
| 6,183,307 | B1 | 2/2001 | Laity et al. | |
| 6,373,944 | B1 * | 4/2002 | Beavers | 379/438 |

(Continued)

FOREIGN PATENT DOCUMENTS

DE 20107145 U1 9/2001

(Continued)

*Primary Examiner* — Tulsidas C Patel
*Assistant Examiner* — Harshad Patel
(74) *Attorney, Agent, or Firm* — Rankin, Hill & Clark LLP

(57) ABSTRACT

A device which on the one side (socket side) includes a plug portion which may be inserted into the standardized plug socket. A plurality of chambers (15) is present on the other side (plug side), into which in each case a plug may be inserted. Moreover, the device has a plurality of adapter contacts which by way of introducing the plug portion into the socket, may be brought into electrical contact with the socket contacts. In each of the chambers, at least two of the adapter contacts are electrically conductively contactable by way of plug contacts of the introduced plugs. The chambers are at least partly present within the socket opening, i.e. the inserted plugs project into the socket opening, so that at least one piece of the plug lies within the socket opening.

20 Claims, 7 Drawing Sheets

U.S. PATENT DOCUMENTS

| | | | | |
|---|---|---|---|---|
| 6,419,527 | B2 | 7/2002 | Reichle | |
| 6,572,411 | B1 * | 6/2003 | Aeschbacher et al. | 439/620.21 |
| 6,793,517 | B2 * | 9/2004 | Neer et al. | 439/372 |
| 6,964,585 | B2 * | 11/2005 | Blichasz et al. | 439/638 |
| 6,988,914 | B2 * | 1/2006 | Pepe et al. | 439/638 |
| 7,189,119 | B2 * | 3/2007 | Blichasz et al. | 439/638 |
| 7,294,024 | B2 * | 11/2007 | Hammond et al. | 439/676 |
| 2002/0146113 | A1 | 10/2002 | Chu | |
| 2005/0059295 | A1 * | 3/2005 | Chen et al. | 439/540.1 |
| 2005/0181643 | A1 * | 8/2005 | Brower et al. | 439/76.1 |

FOREIGN PATENT DOCUMENTS

| | | | |
|---|---|---|---|
| EP | 0018654 | A1 | 11/1980 |
| EP | 0073104 | A1 | 3/1983 |
| EP | 0227153 | A1 | 7/1987 |
| EP | 0685905 | A2 | 12/1995 |
| EP | 1128494 | A2 | 8/2001 |
| FR | 1496312 | | 9/1967 |
| WO | 97/15965 | A1 | 5/1997 |
| WO | 2005/107024 | A1 | 11/2005 |

* cited by examiner

Fig. 15
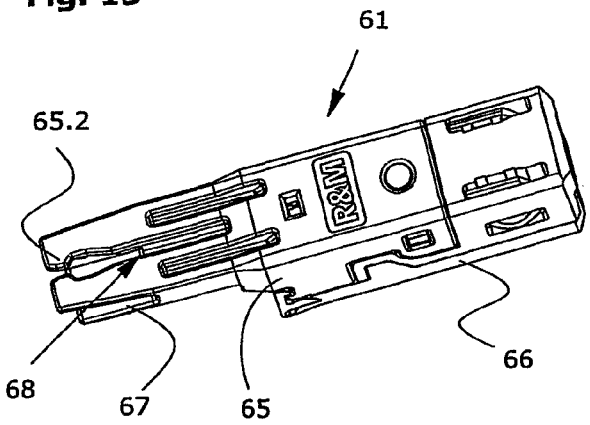
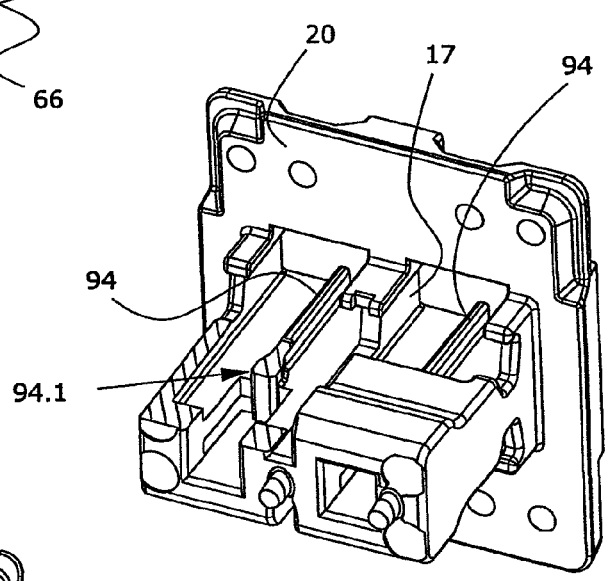
Fig. 16
Fig. 17
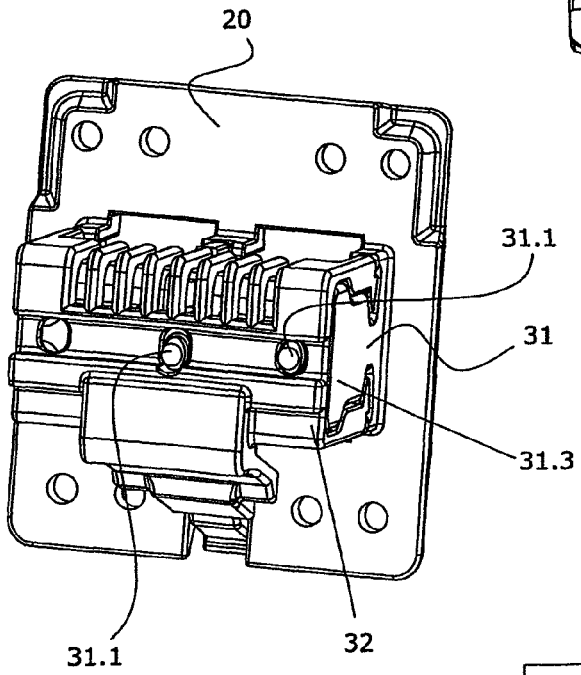
Fig. 18
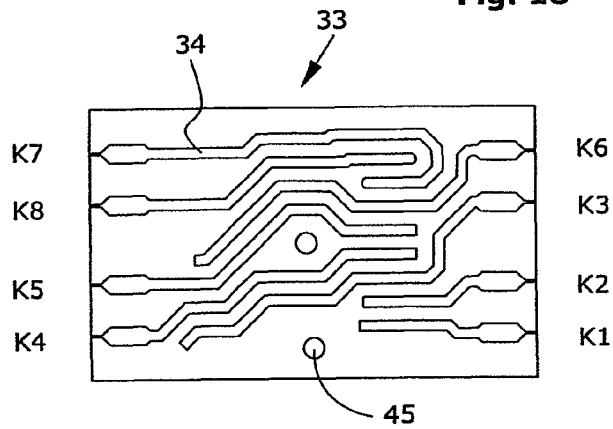

ADAPTER AND PLUG-IN CONNECTION SYSTEM

BACKGROUND OF THE INVENTION

1. Field of the Invention

The invention relates to a device for connecting a plurality of plugs to a standardised plug socket, as well as to a plug system and a plug-and-socket distribution module.

2. Description of Related Art

Plug-and-socket connectors which are applied worldwide and are standardised, exist for electrical signal leads in the wiring of buildings, such as for example the widespread RJ45 plug-and-socket connector (International Standard IEC 60603-7) and the related plug-and-socket connectors according to the standard family IEC 60603-7-x, for example the Standard IEC 60603-7-7, or according to IEC 61076-3-110, and further systems which, for example, are compatible with these plug-and-socket connectors. Common to these plug-and-socket connectors is the fact that they each comprise at least eight plug contacts. Accordingly, it is common to use one cable with four twisted core pairs per connection point. Moreover, plug-and-socket connector types which are derived from the above mentioned plug-and-socket connectors, such as RJ11 and RJ12 systems with at least four plug contacts and two twisted core pairs, exist. Often, applications to the wiring system of a building are carried out, which do not require all two or all four pairs. Because of this, the possibility of being able to render unused cable pairs usable for other services exists in these cases. The common use of a cable is often called cable sharing or splitting.

Often, RJ45 plug sockets (or plug sockets according to a related standard) are already installed in the building in a fixed manner. For this reason, the desire exists for a device (adapter, splitter), which on the one hand may be introduced into the already existing plug socket, and into which on the other hand several plugs for the different services may be inserted. Such splitters of the conventional type however have the disadvantage that they require quite a lot of space in front of and around a socket, to the extent that adjacent sockets may not possibly be used. Moreover, inherent of the design, the splitters project from the sockets and as a result are exposed to mechanical influence and damage. Furthermore, the relatively largely dimensioned splitters, as the case may be, may negatively affect the transmission performance, and under certain circumstances require an extensive compensation.

A splitter system which alleviates these deficiencies, is known from EP 1 128 494. This system is based on an adapter which may be introduced into a RJ45 socket and into which up to 4 splitter plugs may be introduced next to one another. Here however, it is disadvantageous that the splitter plugs need to be constructed in a very narrow manner, and for this reason can hardly be handled. Moreover, the cross-connecting of the pair 3/6 requires a complex and expensive leading of the contacts.

It is therefore the object of the invention to provide a device for connecting a plurality of plugs to a standardised signal lead plug socket, which overcomes the above mentioned disadvantages of the state of the art.

BRIEF SUMMARY OF THE INVENTION

This object is achieved by the device as is defined in the patent claims.

The device according to the invention, on the one side (socket side), comprise a plug portion which may be introduced into the standardised plug socket. A plurality of chambers is present on the other side (plug side), into which a plug may be introduced in each case. Moreover, the device comprises a plurality of adapter contacts, which, by way of the introduction of the plug portion into the socket, may be brought into electrical contact with the socket contacts. At least two of the adapter contacts may be contacted in an electrically conductive manner behind each of the chambers by way of plug contacts of the introduced plugs, for example by way of them having a section lying bare behind the chamber, or by way of them being covered by an element within the chamber, said element being able to be pushed away or pivoted on inserting the plug. The chambers lie at least partly within the socket opening, i.e. the inserted plugs engage into the socket opening, so that at least a part of the plug lies within the socket opening. Moreover, according to the invention, they are present in an arrangement, in which at least two chambers lie above one another with respect to the socket contacts. This means that if a first extension direction (hereinafter "first direction" or "x-direction") is defined by the arrangement of the at least four socket contacts lying next to one another, at least two chambers are arranged next to one another (they are arranged "above one another") with respect to a second or perpendicular extension direction (the y-direction), which is different to this, and they are distanced to one another in this second direction, for example by at least the height of a chamber. The z-direction according to this definition corresponds to the insert axis or plug axis. A separating wall between these at least two chambers preferably runs along the first direction, i.e. parallel to the x-axis or parallel to the x-z plane.

The electrical connection between the socket contacts and the plug contacts, which is created by the device, is an electrical contact as previously mentioned, i.e. a direct connection which is not effected via active or passive electronic components (with the exception of the ohmic resistance corresponding to the residual resistance of the contacts and of the contact resistance). Thus existing socket contacts and plug contacts of the introduced plugs are connected through in an electrically conductive manner by way of the adapter contacts, i.e. a continuous galvanic connection exists, wherein of course generally no electrical connection between different plug contacts of an inserted plug is created by the adapter. In special embodiments however, it is possible for the adapter to create an electrical connection between plug contacts of different plugs, which will be explained in more detail hereinafter.

Particularly preferably, the chambers are present "next to one another" as well as "above one another", i.e. they are present in a two-dimensional arrangement, and are distanced from one another in two directions which are generally perpendicular to one another.

For example, four chambers may be present, which form a rectangular-like arrangement. Alternatively to this, only two chambers lying above one another, i.e. distanced in the y-direction, may be present. As a further alternative, two chambers lying next to one another and a larger one lying thereabove or therebelow may be present.

The terms such as "above one another", "next to one another", "vertically", "horizontally" hereinafter always relate to the arrangement of the at least four socket contacts lying next to one another, i.e. "next to one another" and "horizontally" relate to the x-direction connecting the mentioned socket contacts, "vertically" or "above one another" relate to the direction perpendicular thereto, independently of the orientation of the socket. "Plug-side" means along the insert axis on the side of the plug, "socket-side" accordingly along the insert axis on the side of the socket.

The device is preferably designed for standardised RJ45 plug sockets and/or 8-poled rectangular plug sockets with the same external dimensions, for example for plug connectors of the family IEC 60603-7-x, in particular IEC 60603-7-7, or according to IEC 61076-3-110. As one possibility, the device according to the invention includes a switch actuation projection, which, with plug sockets of the standards IEC 60603-7-7 and IEC 61076-3-110, given a complete introduction of the device into the socket, actuates a switch which connects certain socket contacts in parallel. The device according to the invention may also be used for other standardised plug sockets, for example for the four-poled plug sockets of the types RJ11 and RJ12, and further ones.

The invention makes use of the recognition, that a plurality of chambers into which in each case a plug may be introduced, may be present within a RJ45-socket or a differently standardised socket for a four-poled or eight-poled rectangular plug, generally with the same external dimensions as the RJ45-socket, and that an arrangement of the chambers in which these also lie above one another, makes sense, despite the linear arrangement of the RJ45-contacts in the socket. Thus, a device is provided, which despite very restricted spatial conditions, permits the contacts to be led on different planes within the RJ45 (or comparable socket). The invention thus takes a different approach than the linear concept with contacts/plugs next to one another, which is particular to the RJ45 and comparable sockets—such a concept corresponds also to the arrangement of EP 1 128 494—towards a two-dimensional arrangement of contacts within the socket, which for example is only 12×7 mm in size (dimensions within the socket, i.e. the socket opening). By way of this procedure, one may also yet solve the problem of the cross-connecting of the contact pairs 4/5 and 3/6 with RJ45 sockets, by way of one of these contact pairs being led "to the top" and the other "to the bottom".

According to the invention therefore, the chambers are designed and dimensioned such that at least a part of the plug introduced into the chambers projects into the socket opening. This is advantageous, since by way of this, the device may be designed such that it does not project out of the socket opening, or only to a small extent. Accordingly, it is less exposed to mechanical influence and damage, and its spatial requirement is low.

According to one embodiment, the device may be provided with a flange which runs around the socket, is arranged in front and bears on the socket front plate, and on which flange one may incorporate a colour coding, for example in the form of platelets. Alternatively, the device may also be designed such that it practically completely disappears in the socket opening.

The separated chambers simplify the handling, since by way of them, it is immediately clear where the plug must be inserted. The separating walls between the chambers advantageously reach up to the front side of the device, on the plug side, i.e. they are then not set back within the socket. They are preferably continuous, i.e. are not interrupted.

The principle of the chambers which are separated by separating walls and which are located at least to some extent within the sockets, according to one modification of the invention, may also be applied to at least two chambers which are merely arranged next to one another. Such a modified device may, for example, be used as a splitter for the four-poled plug systems such as RJ11 and RJ12. According to this modification, thus the feature that the chambers are distanced from one another in a direction which is different from the x-direction, is not a necessary feature.

The chambers—according to each of the previously discussed embodiments—may also be designed such that a plug may only be inserted in the correct orientation. A mechanical coding may also be present, by way of which an insertion of a plug into a wrong chamber (wrong plug space), is prevented. For example, with this, the insertion of a signal plug into a chamber envisaged for the telephone, or with Power-over-Ethernet applications and comparable ones, the insertion of a signal plug into a chamber provided for power transmission, may be prevented.

The device in which four chambers are present is particularly preferred, wherein then in exactly two of the (then) eight adapter contacts may be contacted in each chamber. In this embodiment for example, four plugs may be used in each case with one contact pair, a double plug with two contact pairs, and two plugs with one contact pair, or two double plugs with, in each case, two contact pairs. The double plugs are then designed such that they include plug portions which may be introduced in each case into a chamber, and with in each case two contact elements, and a corresponding recess between these for the separating wall running between the two chambers.

Likewise of interest, but less flexible, is the device with a chamber with four adapter contacts, and two chambers with, in each case, two adapter contacts.

Generally, it is preferable for all eight contacts of the standardised plug socket to be contacted by adapter contacts, i.e. no contacts are "lost". As an alternative, the device however may also form a branching ("Y-piece"), so that the adapter contacts electrically connect contact locations of different chambers to one another, wherein for this, contact pairs of the socket are not contacted by the adapter contacts. A particularly preferred use as a branching is that of an ISDN bus.

According to a preferred embodiment, contact locations of the adapter contacts are "male" on both sides, i.e. free of moving, resilient parts. This necessitates the plugs for introduction into the chambers being "female", i.e. being provided with resilient contacts. It has been found that this principle "male-male" of the device, permits a particularly inexpensive and particularly space-saving design.

Particularly preferably, the adapter contacts are formed by strip conductors of a flex-print ("flex circuit board"). Depending on the embodiment, the strip conductors forming the adapter contacts—particularly if they cross—may yet comprise through-contacts between different strip conductor planes.

The adapter contacts preferably lie such that the pairs 3/6 on the one hand and 4/5 on the other hand do not lie horizontally next to one another, but on different planes (i.e. distanced from one another in the vertical direction). This on the one hand is advantageous for the leading of the adapter contacts, since then no or less cross-connecting is required. Moreover, it is advantageous for certain applications if the contact pairs 1/2 on the one hand and 7/8 on the other hand, to come to lie on different planes and lie opposite one another in a crossed and point-symmetrical manner. One advantage of this configuration results in particular for CATV applications: only the contact pairs 1/2 and 7/8 may be used for these applications, depending on the quality demands with regard to the signal transmission (Category 7 (Kat.7) transmission power). By way of using one double plug per CATV connection and by way of the contact pairs 1/2 lying opposite on the one hand and 7/8 lying opposite in a crossed manner, one may prevent the contact pairs 4/5 or 3/6 from erroneously being used for CATV signal transmission, without a mechanical coding being required, which would tend to be rather filigree in view of the special conditions.

Likewise the subject-matter of the invention is a plug-and-socket system with a device according to the invention, and at least one plug which fits with this. Such plugs advantageously comprise resilient plug contacts.

Preferably, these plugs ("splitter plugs") are designed such that they may be assembled in the field, in order to permit a simple convertibility of existing apparatus. For this reason, they comprise for example a plug base part with the plug contacts and a plug attachment functioning as a wiring cover. The plug contacts are designed resiliently on the one side. On the other side they are designed, for example, in a manner known per se with insulation displacement connectors or possibly piercing contacts, clamping (crimping) contacts or other contacts. The plug attachment comprises means for receiving and leading the insulated cable cores. The cable cores are contacted by way of the corresponding plug contacts by way of leading together the plug attachment and the plug base part.

Preferably, a purely non-positive fit retaining device (without positive fit or even material fit) exits between the plugs and the device according to the invention, so that the plugs may also be removed from the splitter insert by pulling the cable, for a simplified handling in view of the very small dimensions. Alternatively, it is also possible to provide a positive-fit locking.

A plug-and-socket distributor module, which in particular is suitable for plugs of the previously described type, also belongs to the invention. The plug-and-socket distributor module apart from a front element which may form a panel-like front in the manner known per se and includes a plurality of plug openings rowed next to one another, also includes a circuit board. This is arranged such that the strip conductors of the circuit board form respective contact locations along the edge facing the front element, which are electrically contacted by the resilient electrical contacts of the plugs, when these are introduced through one of the plug openings from the front side.

Additionally, the plug-and-socket distributor module preferably includes contact blocks, which in each case comprise at least two contact elements which are fastened on the circuit board—as the case may be—via a holding element. These on the one hand include means for contacting cable cores, for example IDC insulation displacement connectors. On the other hand, they are electrically connected to a strip conductor. The contact blocks may include guide webs in a manner known per se, between which the cable cores may be introduced, as well as wiring means, with which the cable cores introduced between the guide webs are pressed deeper between the guide webs and by way of this may be wired by way of IDC technology.

Particularly preferably, the plug openings and the circuit board are designed and arranged, such that when the plug is introduced, the edge of the circuit board projects into a slot which is formed by the plug and in which the plug contacts lie bare. This slot may be matched in width to the thickness of the circuit board (or vice versa) and may guide the plug on introduction into the plug-and-socket distributor module as well as on introduction into the device according to the invention.

The possibility of providing such a plug-and-socket distributor module with plug openings which under certain circumstances are tightly rowed on one another, and with unmovable contact locations which are favourable with regard to manufacture, is a further advantage of the plug-and-socket system according to the invention.

BRIEF DESCRIPTION OF THE DRAWINGS

Preferred embodiments of the invention are described hereinafter by way of drawings. There are shown in.

DETAILED DESCRIPTION OF THE INVENTION

Figure 1:
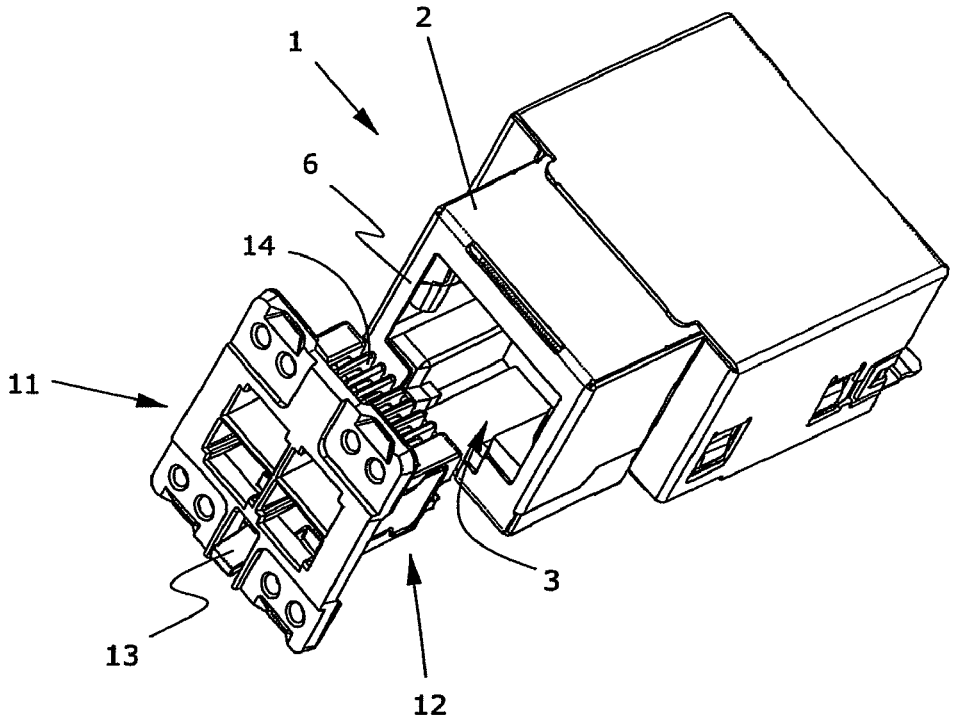
FIG. 1 a view of a RJ45 socket and a device according to the invention.

One may see a RJ45 socket 1 of the known type in FIG. 1. The socket is provided with an electrically conductive shielding 2, as is necessary for certain applications. The resilient socket contacts lie exposed in the inside of the socket opening 3—covered in the figure—and may be contacted by plug contacts of a RJ45-plug.

The plug-side end-face 6 of the socket is hereinafter indicated as the panel surface. The socket opening extends inwards from the panel surface.

Figure 2:
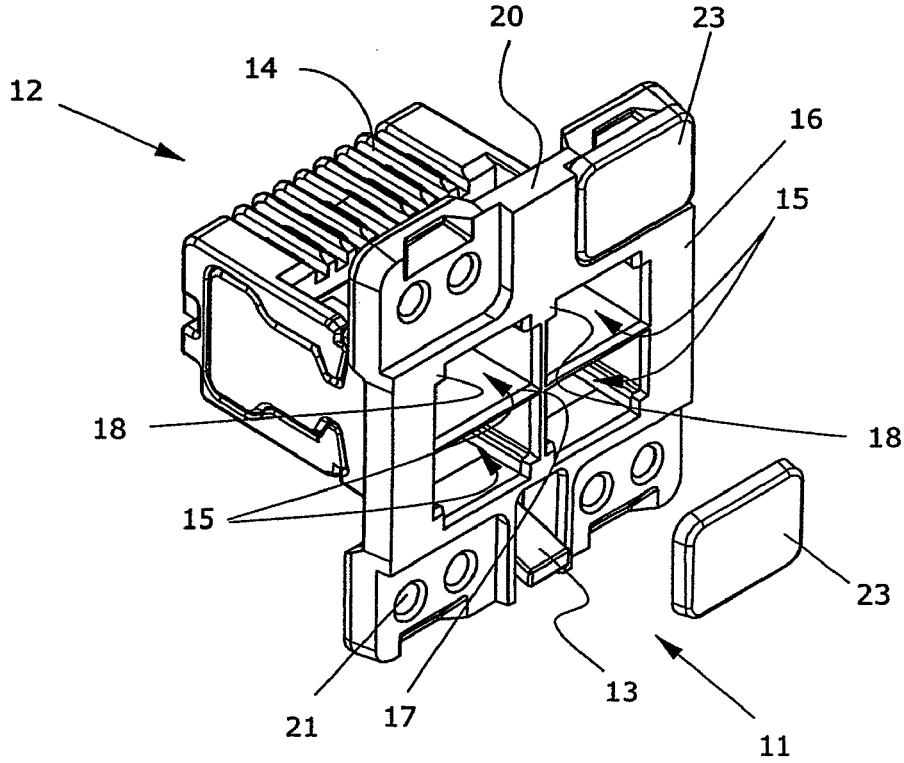
FIG. 2 a view of a device according to the invention.

The device 11 according to the invention, amongst others, is shown in FIG. 1 and also in FIG. 2. It functions as a "splitter", i.e. it serves for separating signal leads. On the one side, it comprises a plug portion 12 which may be introduced into the socket, wherein the user may lock the device into the socket as is known from RJ45 plugs. A pawl 13 serves for the release of the locking connection. The locking mechanism is known per se and is not described in detail here. A locking mechanism could also be designed in a different manner than is known from the RJ45 plug connections. Adapter contacts, onto which the resilient socket contacts 5 are pressed when the plug portion is introduced into the socket, lie bare between the intermediate webs 14, as is known from RJ45-plugs.

On the front side, i.e. on the plug side, several chambers 15 are formed on the device, which extend from a plug-side end-face 16 of the device into the inside. The chambers in the plug-side end-face are arranged next to one another as well as above one another. In the represented example, the chambers are distributed onto four corners of the standardised plug socket and form a rectangular arrangement. Plugs may be introduced into the chambers, in a manner such that their plug contacts contact the adapter contacts, which is yet described hereinafter. Separating walls 17 are formed between the chambers 15. In the represented embodiment, the separating walls reach right to the front to the plug-side end-face of the device. This, however, does not necessarily need to be the case, and indeed the separating walls may also be slightly displaced to the rear. The separated chambers for the plugs are advantageous on handling, since it is immediately clear as to where the plugs must be inserted.

The insert axis and plug axis here runs perpendicularly to the plug-side end-face 16.

The chambers here in each case have at least one guide projection 18 and in each case there are two guide projections in the figure. The shape of the chambers deviates from the rectangular cross section by way of this (these), by which means, given an interaction with a corresponding recess of the plug, it is ensured that the plug may only be introduced in the correct orientation. Of course, other means, with which this may be ensured, are also known to the man skilled in the art. Thus, for example, the chamber may also comprise a groove instead of a guide projection, into which groove a corresponding projection of the plug may be introduced, or the chamber and the plug have a different non-rectangular cross section.

Moreover, one may effect a mechanical coding by way of suitable shaping formations in the manner of the guide projection 18 or in the form of a cam or a groove or other shaping formations, by way of which the chamber differs from a purely rectangular cross section. For example, depending on the application, only a plug of the type "1" or only a plug of the type "2" may be introduced into the respective chamber. The system of the mechanical coding, in a manner known per se, may also envisage there being plugs which fit into very chamber, and there being chambers, into which every plug fits.

On the plug side, a flange 20 is yet formed on the device, which covers the panel surface in the environment of the socket. Here, the flange serves for being able to attach colour coding plates 23. For this, for example in each case two fastening holes 21 are formed on the four locations assigned to the chambers. With these, the colour coding plates 23 may be fastened in the manner of push buttons; and other fastening types are of course also possible. Alternatively to the drawn embodiment, one may however also make do without the flange, and the device may, for example, be designed such that it completely disappears in the socket opening.

Figure 3:
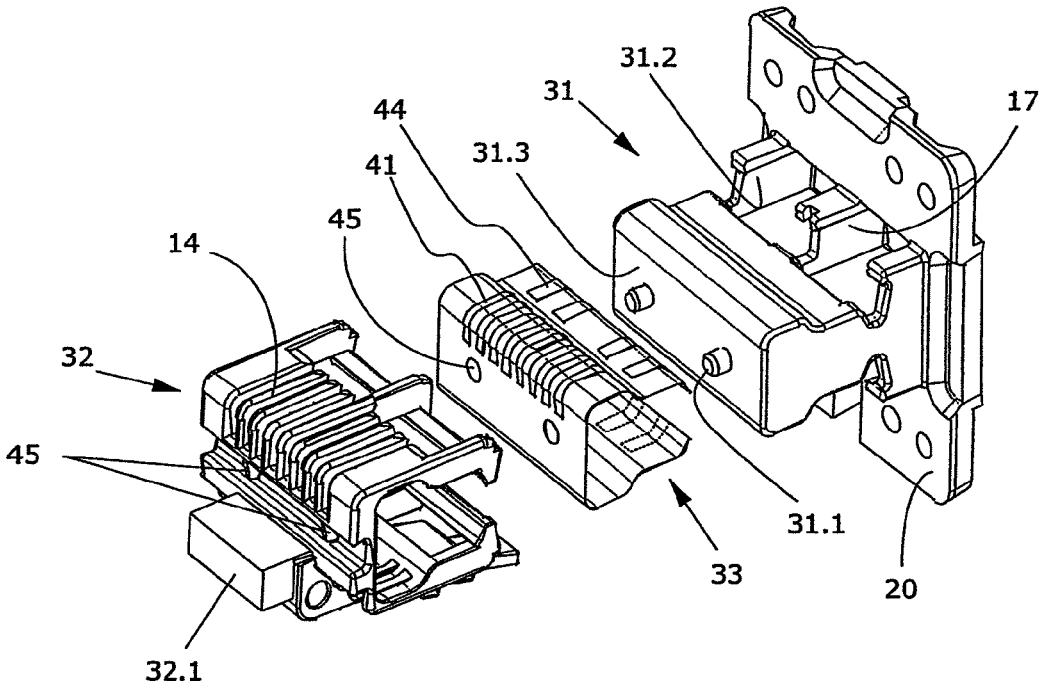
FIG. 3 an exploded representation of the device according to FIG. 2.

FIG. 3 shows an exploded representation of the three elements, from which the device according to the invention according to the preferred embodiment is constructed. The chambers are formed on an adapter outer part 31 which is manufactured of metal according to a preferred embodiment. Metallic materials have the advantage that the separating walls between the chambers are stable on account of them, even with a small wall thickness. Moreover, the metallic adapter outer part may create an electrical contact between shieldings of the socket and of the plug, without additional means. Of course the adapter outer part may, however, also be manufactured of a hard plastic—possibly metallically coated.

The adapter outer part in the represented embodiment comprises a plate-like portion on the plug side, which forms the flange 20. The separating walls 17 extend inwards from this, as well as possible lateral guide walls 31.21. A protuberance 31.3 connects thereto on the socket side.

An adapter inner part 32 here is manufactured of electrically insulating material, preferably plastic. The adapter inner part comprises ribs, which form the intermediate webs 14 in the assembled condition of the device.

The adapter contacts are designed as strip conductors 34 on an electrical connection element, here on a flex-print 33. Only the contact surfaces are drawn in the FIG. 3, i.e. the course of the strip conductors is not represented. In the assembled condition of the device, the flex-print 33 is applied around the protuberance 31.3 of the adapter outer part, and partly encloses this. The adapter inner part 32 embraces the protuberance 31.3, by which means the flex-print 33 which was attached previously on the protuberance in a positionally correct manner, is fixed.

The adapter inner part 32 in the shown embodiment comprises an optional switch actuation projection 32.1, which with plug sockets of certain standards (for example of the standard IEC 60603-7-7) with more than eight socket contacts, actuates a switch with the complete introduction of the device into the socket, and this switch connects certain socket contacts in parallel.

Figure 4:
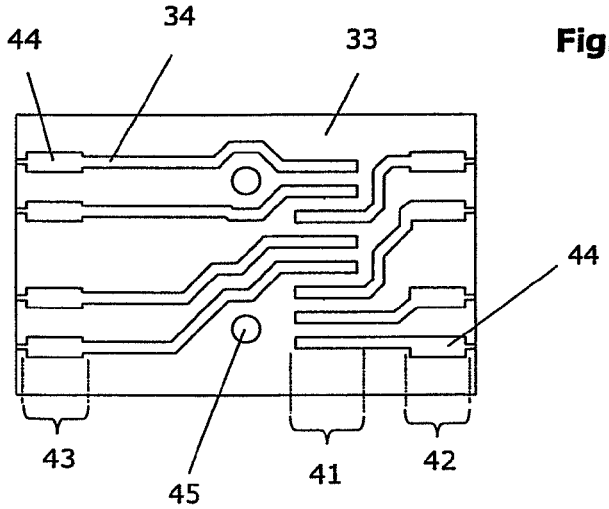
FIGS. 4 and 5 two variants of a flex-print as a building block of a device according to the invention, FIG. 6 representation, partly in section, of a socket with the device according to the invention and with plugs inserted therein, FIG. 7 a representation, partly in section, of a device according to the invention with plugs inserted therein, FIG. 8 a view of a plug for a contact pair, FIG. 9 an exploded representation of the plug according to FIG. 8, FIG. 10 a view of a plug for two contact pairs, FIG. 11 an exploded representation of the plug according to FIG. 10, FIG. 12 a view of a dust protector, FIG. 13 a schematic front view of one variant of the device according to the invention, FIG. 14 a plug-and-socket distributor module, FIG. 15 a view of a further plug for a contact pair, FIG. 16 a view (with part section) of the adapter outer part of one variant of the device according to the invention FIG. 17 a representation of the variant of the device according to the invention, FIG. 18 of a further flex-print as a building block of a device according to the invention, and FIGS. 19-22 representations of a plug for two contact pairs or of elements thereof.

Whereas only the contact surfaces of the strip conductors are represented in FIG. 3, the strip conductors 34 are fully illustrated in FIG. 4 as an example. In the assembled condition of the device, the flex-print is applied around the adapter outer part in a U-shaped manner. FIG. 4 shows that side of the flex-print, which lies to the outside with respect to the U-shaped arrangement, in the assembled condition of the device. The inner side of the flex-print is, for example, not provided with strip conductors. It may, however, also comprise strip conductors or insulated conductor surfaces, which for example, serve for the compensation of crosstalk effects and/or which fulfil yet further tasks. If this is the case, and the adapter outer part is electrically conductive, and these optional inner-side conductor structures need to be coated with an electrically insulating layer.

In a socket contact region 14, the eight strip conductors are arranged in an equidistant manner and at positions as are required by the respective plug standard. Four contacts run from this socket contact region 41 into a first plug contact region 42, where in pairs, they form the contact locations 44 for the plug contacts, said contact locations lying bare in the upper two chambers. The respective contact locations 44 in the shown embodiment are widened and are distanced further, in order to permit a simple and secure contacting. The remaining four contacts run onto the lower side into a section plug contact region 43, where in pairs they form the contact locations 44 for the plug contacts, said contact locations lying bare in the two lower chambers. In the drawn embodiment, the contact pair 3/6 and one of the two outer contact pairs (here 1/2) are led upwards, and the contact pair 4/5 and the other of the outer contact pairs (here 7/8) are led downwards; but it may also be the case of this being the other way round. At all events, it is advantageous for reasons of a simpler leading of the strip conductors, for the contact pairs 3/6 and 4/5 not to be guided on the same plane. It is likewise advantageous for the two outer contact pairs not to lie on the same plane and to lie opposite in a point-symmetrical manner.

The strip conductors may also be coated with an insulating layer outside the socket contact region 41 and the plug contact regions 42, 43, on the outer side shown in FIG. 4.

Yet two positioning holes 45 are visible in FIGS. 3 and 4, into which the respective positioning pins 31.1 of the adapter outer part 31 (or, alternatively to the drawn embodiment, of the adapter inner part) engage, and set the relative position by way of this.

Figure 5:
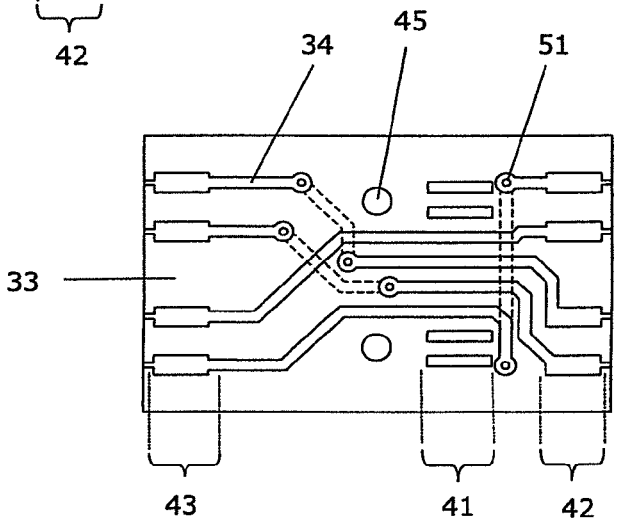

FIG. 5 shows a flex-print 33 as may be used for an alternative embodiment of the device according to the invention. In this alternative embodiment, the strip conductor pairs 4/5 on the one hand, and 3/6 on the other hand are led in each case to the contact locations of the two upper or of the two lower chambers, i.e. the contact locations of the chamber ("top left" and "top right" are led parallel to the contact locations of the chamber "bottom right" or "bottom left" (Y-piece). The two outer contact pairs of the socket are not used with this embodiment.

Inherent of the technical layout, i.e. for geometric reasons, the strip conductors of the flex-print of FIG. 5 must cross. For this reason, some of the strip conductors have sections which run on the other side ("inner side") and which are represented in the figure by way of dashed lines (as invisible strip conductors). Leadthroughs 51 ("vias", "feedthroughs") are present between the sections of the strip conductors, which run on the front side and on the rear side. On the inner side, the strip conductors are preferably covered by an electrically insulating layer, so that no electrical contact to the possibly conductive adapter outer part may arise.

In this embodiment, the device according to the invention serves as a Y-piece, for example for an ISDN-bus.

Of course, the functions of the flex-prints according to FIGS. 4 and 5 may also be realised with circuit boards other than those which are shown. Multi-layer embodiments of the flex-print (so-called multilayers) are also conceivable.

Alternatively to a flex-print, one may also apply other means for manufacturing a contact between contact locations in the chambers and the socket contacts of the socket described here. Non-flex-like electrical connection elements (i.e. circuit boards shaped according to requirement), punch contacts or other electrical contacts may also be considered as such alternatives. However, the mentioned flex-prints are particularly advantageous, since they permit a particularly inexpensive and space-saving construction of the device.

In the inserted condition of the device, the—resilient—socket contacts 5 of the standardised plug socket 1, in the socket contact region 41, contact the strip conductors functioning as adapter contacts. If a plug is inserted into the device, the first plug contact regions 42 are contacted (by way of plugs inserted into the upper chambers) and/or the second plug contact regions 43 are contacted (by way of plugs inserted into the lower chambers).

Figure 6:
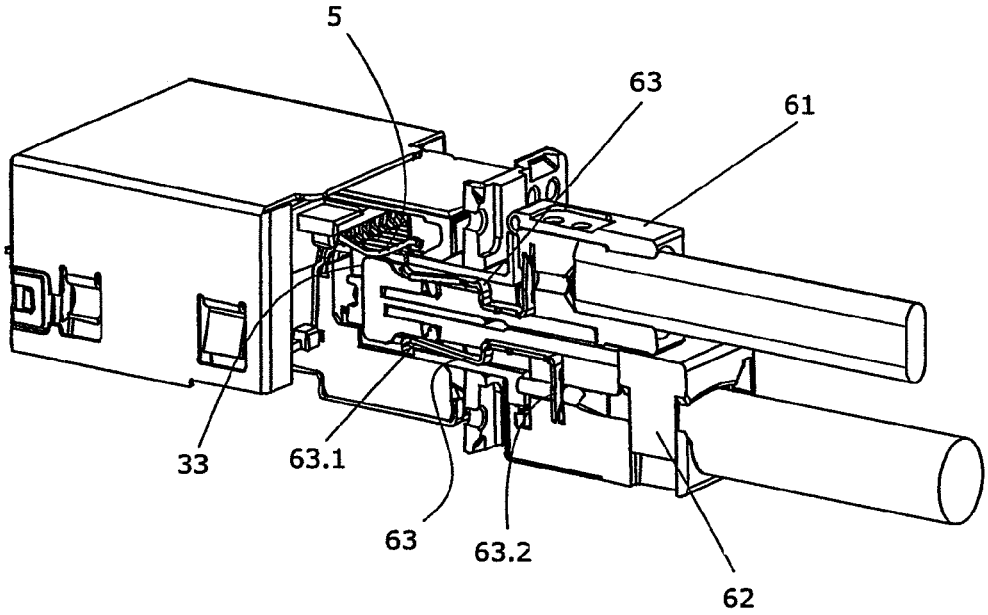
Figure 7:
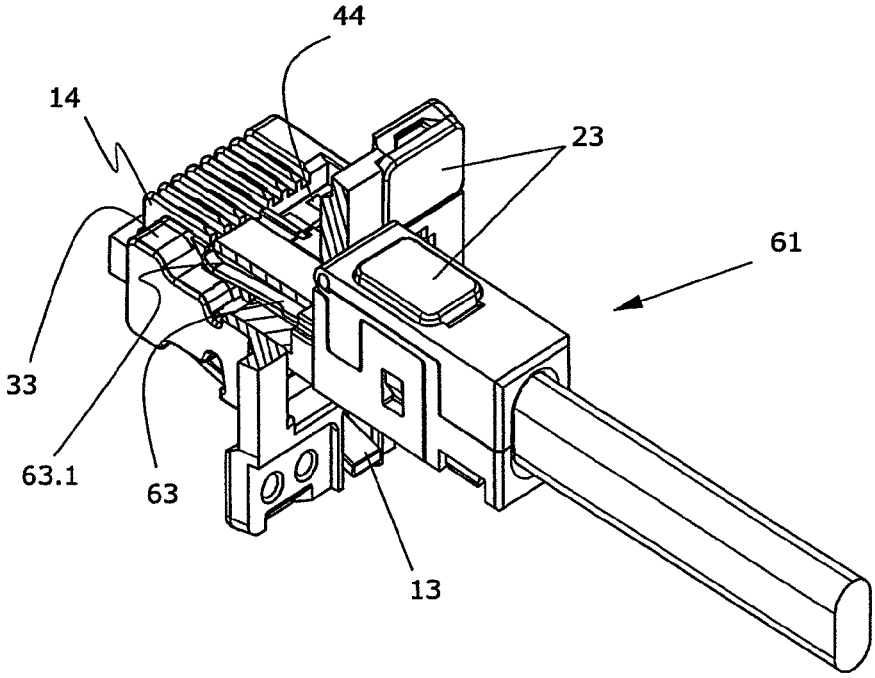

One may see this functioning principle of the device according to the invention in a somewhat clearer manner in the representation according to FIGS. 6 and 7. Individual plugs 61 and/or double plugs 62, which in each case comprise plug contacts 63, may be introduced into the chambers 15. The plug contacts are designed resiliently "female" in a contact region 63.1, so that they are pressed onto the contact locations 44 in the inserted condition of the plug 44 and contact these contact locations. The plug contacts 63 may be provided with insulation displacement connectors 63.2 and in this manner by way of the insulation displacement connector technology, may contact the conductor cores of the departing (or arriving cable) straight away.

The plug contacts are, for example, manufactured of spring bronze, wherein the surfaces may be treated according to function, for example, the contact region 63.1 may be gold-coated and/or the insulation displacement connectors 63.2 may be tin-coated.

Figure 8:
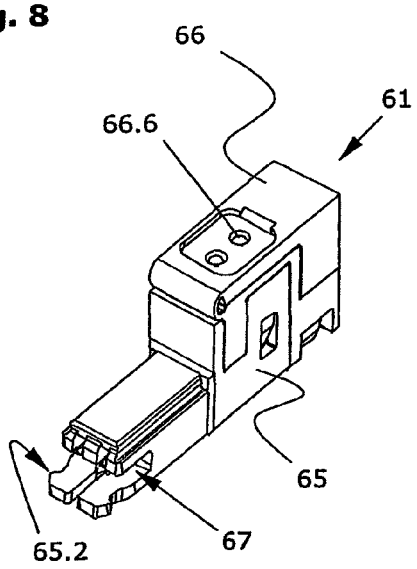
Figure 9:
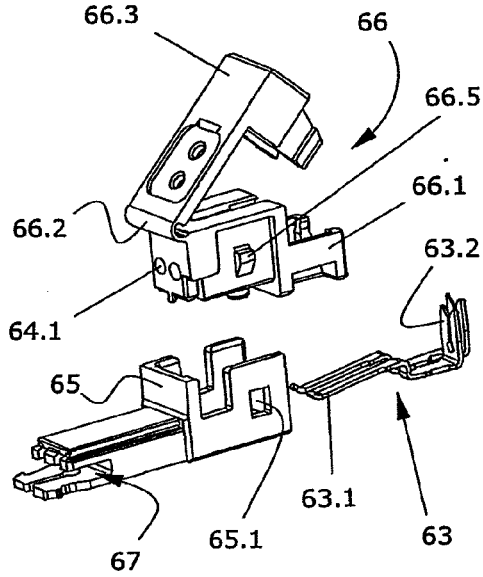

The FIGS. 8 and 9 show one embodiment of a plug 61 of the type 1 in a yet more detailed manner. The plug comprises a plug base part 65 and a plug attachment 66 functioning as a wiring cover. The plug base part accommodates the plug contacts 63 and holds them in position. The resilient sections 63.1 of the plug contacts—as mentioned they form the contact location—lie in the inside of a slot 67 which is formed by the plug base part, by which means a contact protecting is effected. A further advantage of the slotted design is that a direct contacting of contact surfaces on a circuit board is possible with the plug, which is discussed hereinafter in yet more detail.

The wiring and fixing of the electrical conductors (cable cores) is effected by way of the plug attachment 66. The plug attachment optionally comprises a base part 66.1 and a pull relief part 66.3 which is pivotably connected via a film hinge 66.2 to this base part. The conductors are firstly led through two longitudinal openings 66.4 (for example bores) of the plug attachment. Subsequently, the pull relief part 66.3 is folded towards the base part and, thus, fixes the cable as a whole. Thereupon the core sections projecting out of the longitudinal openings may be cut to length in a flush manner on the front side. The plug attachment 66 is then pressed onto the plug housing provided with the plug contacts 63 and, thus, connects the conductors. For example, the plug attachment comprises locking projections 66.5 for locking, which engage into corresponding openings 65.1 of the plug base part.

At the very front, lug-like projections 65.2 are formed on the plug portion 61 on the plug 61, and these projections with a corresponding counter-piece in the device serve as catches for a non-positive fit, when the plug is introduced into the respective chamber.

The plug 61, as the flange 20 of the device, yet comprises fastening holes 66.6 for fastening a coding plate 23, which is drawn in FIG. 7.

Figure 10:
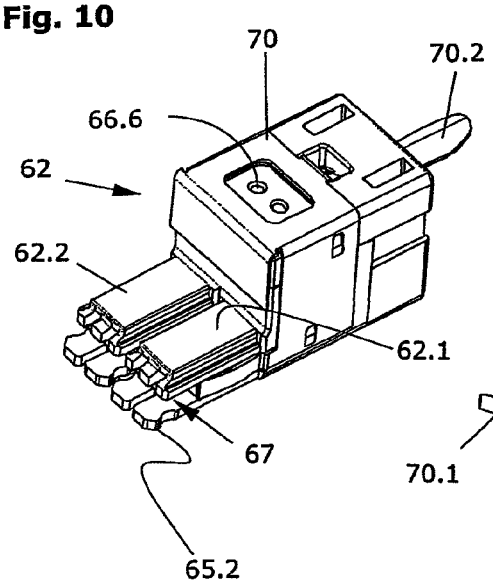
Figure 11:
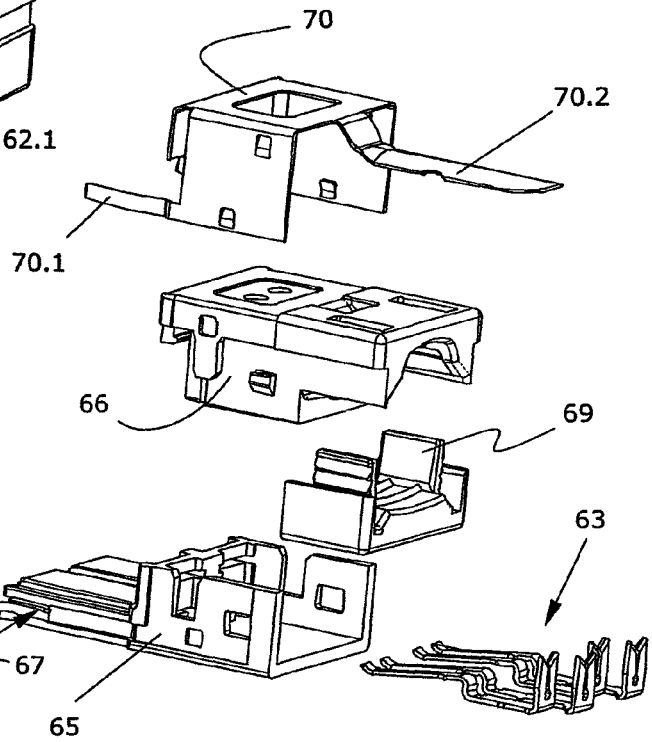

A plug variant for a four-core cable is represented in FIGS. 10 and 11. The plugs 62 have two plug portions 62.1, 62.2, which in each case may be inserted into one of two chambers 15 of a device 11 according to the invention, lying next to one another, and which in each case comprise a slot 67 of the type mentioned above. The wiring of the plug 62 is effected analogously to the procedure which has been described above by way of the two-core version, wherein in contrast to the latter, a for example separate bridge-like pull relief part 69 is provided for pull relief, which after the positioning of the cable in the plug attachment 66, is clipped onto this, by which means the plug attachment requires no pivotable element. The pull relief part 69 is designed with a locking closure, in order to be able to provide a pull relief for cables of different diameter.

The plug shown in FIGS. 10 and 11 yet comprises a shielding 70. This is manufactured, for example, from a sheet metal. It comprises at least one first contact tongue 70.1, which in the inserted condition is contacted by a conductive section of the device—for example an inner wall of a chamber 15. A second contact location—here for example designed as a contact tongue—70.2, serves for creating an electrical contact to a shielding of the cable connected to the plug.

FIGS. 8-11, of course, only show two examples of many, as to how the plugs may be designed, and the man skilled in the art would conceive further versions with various wiring mechanisms and pull relief mechanisms with or without shielding. Thus for example one may also provide a singular plug 61 as drawn in FIGS. 8 and 9, with a shielding. Preferably, in any case the plug contacts 63 are designed such that they have a resilient contact region. Here too, one may conceive a non-resilient embodiment, which however leads to a more complicated contact zone in the adapter region.

Application possibilities for the device according to the invention include the connection of the following apparatus to a single RJ45 (or related) plug socket:

4 telephones and/or fax apparatus, 2 fast Ethernet LAN connections 1 fast Ethernet LAN connection, 1 telephone and 1 fax apparatus (or 2 telephones or 2 fax apparatus), 2 CATV connections 1 CATV connection and 1 telephone and possibly yet also a fax apparatus or further telephone.

Moreover, the device may also serve as:

Midspan power adapter for PoE (Power over Ethernet), or

ISDN S-bus distribution for 2 apparatus

Figure 12:
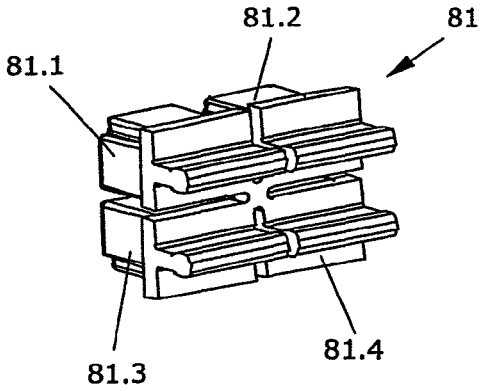

FIG. 12 yet shows a dust protector 81 for the device according to the invention, which comprises four individual plugs 81.1-81.4 which may be individually broken out when required, in order to be able to close the chambers individually, in groups or together, when not in use.

Figure 13:
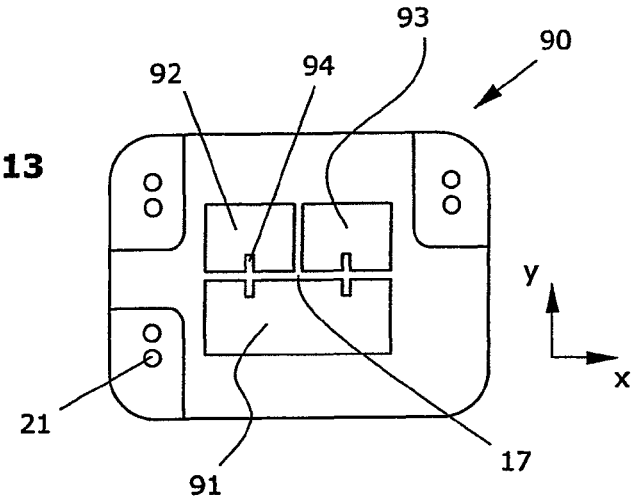

Yet two further optional features of the device according to the invention are described by way of the schematic FIG. 13, which shows a front view of the device. On the one hand, the device 90 in the variant according to FIG. 13 comprises only three chambers, of which a first chamber 91 is roughly double the size of the two other chambers 92, 93, and four adapter contacts. The first chamber 91 serves for connecting a four-poled special plug (not shown) or a double plug 62 of the type represented in FIG. 10, whilst the other chambers 92, 93 are designed as in FIGS. 1-7. The arrangement according to FIG. 13—or another arrangement with a larger "double chamber" and two smaller "singular" chambers—may for example be used as a specialised variant for the connection of a telephone, a fax apparatus or a computer via an Ethernet interface. One advantage compared to the more flexible standard variant according to FIGS. 1 and 7, which provides the same possibilities as well as further ones, may be seen in the fact that less erroneous manipulation may occur on account of the reduced flexibility, and that one, for example, is not dependent or only in a limited manner, on colour coding or mechanical coding.

Further features of the device 90 are security webs 94 which reach up to the front side of the separating walls 17 and which prevent a plug 61, 62 of the previously described type with a front-side slot 67, from being able to be inserted such that a separating wall 17 projects into the slot and causes a short circuit there between plug contacts. Such security webs 94 or means with regard to this, may of course also be used with variants of the device with four chambers.

The optional fastening holes 21 for the coding plates are arranged laterally in the variant according to FIG. 13.

In FIG. 13, the x-axis and y-axis of the coordinate system are drawn in. The x-axis—as with all embodiments—corresponds to the axis which connects the at least four socket contacts lying next to one another, to one another. The y-axis is the direction which lies parallel to the socket front plate. In the arrangements according to FIGS. 2 and 13, in each case separating walls 17 which run parallel to the x-axis are present, as well as those which run parallel to the y-axis.

Figure 14:
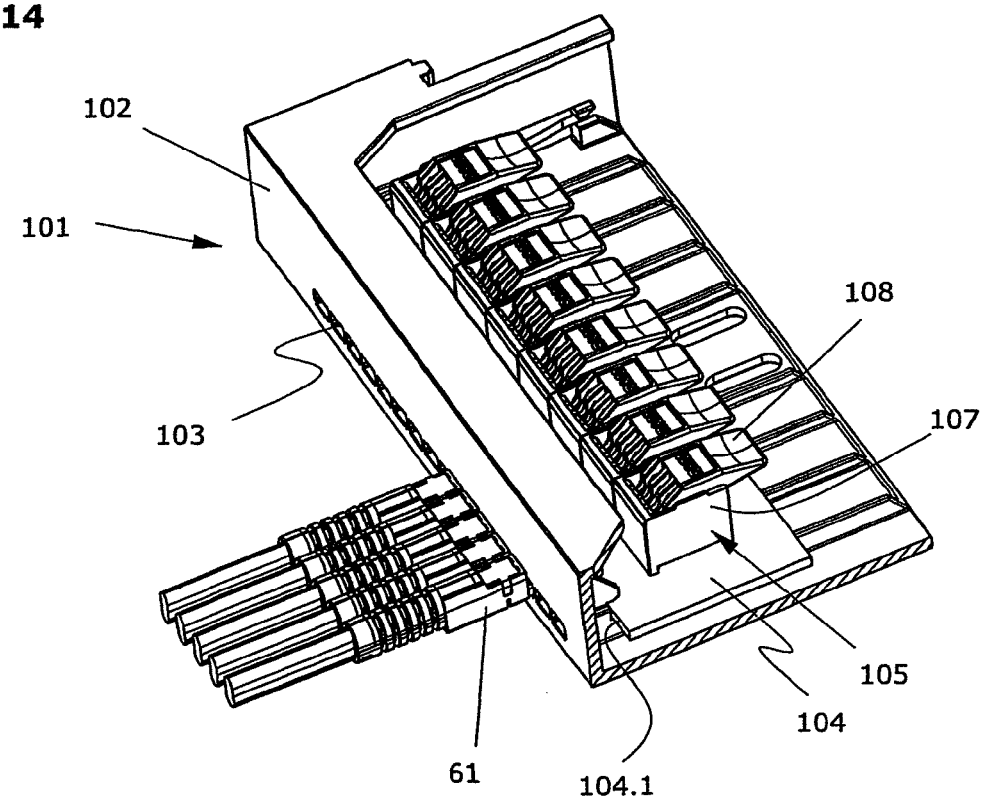

A plug-and-socket distributor module 101 is represented in FIG. 14, which may be used together with plugs of the previously described type. The plug-and-socket distributor module 101 comprises a front element 102 with a plurality of plug openings 103 which are preferably arranged next to one another, and into which single plugs 61 or double plugs 62 may be inserted. The outer dimensions of the plug openings 103 preferably correspond to the outer dimensions of the chambers 15 of the device 11, 90, as the case may be, with the exception of the different mechanical coding. The distance between two plug openings 103 preferably corresponds to the distance of two chambers 15 of the device 11, 90, which lie horizontally next to one another. Preferably therefore, the complete width of two plug openings lying next to one another, including the intermediate space between these two plug openings 103, is smaller or equal to the width of an RJ45 plug socket. The plug openings 103 are preferably arranged in an equidistant manner. The front element 102 in the drawn example is the front plate of a housing or componentry.

The plug and distributor module 101 further comprises a circuit board 104, on which strip conductors with contact locations (not represented in the figure) are present, onto which the resilient contact regions 63.1 of the plug counts 63 press, when the plugs are introduced from the front side through the plug openings. The contact locations are accordingly arranged on one of the surfaces of the circuit board (i.e. in the drawn arrangement on the upper side and/or the lower side) along the edge 104.1 of the circuit board which faces the front plate. The thickness of the circuit board, the position of the plug openings and the width and position of the slots 67 of the plugs are matched to one another such that the inserted plug encompasses the circuit board in the vicinity of the edge 104.1, and, under circumstances, is firmly clamped there by way of the spring force of the contact regions 63.2. Mechanisms which are known per se, may, for example, be provided additionally to the clamping effect, in order to fix a plug connected to the plug-and-socket distributor module In the shown embodiment example, connection blocks 105 for electrical leads are yet attached on the circuit board. These, in a manner known per se, comprise a plurality of insulation displacement connectors, between whose contact terminals an insulated lead is pressed and by way of this may be electrically connected to this. These insulation displacement connectors are for example present on plug-and-socket distributor module contact elements, which are directly soldered onto the circuit board and/or are held by a bore and may be contacted by strip conductors. The connection blocks 105 in each case comprise a connection block base housing 107 for example, which holds the plug-and-socket distributor module contact elements, and a connection block wiring cover 108 with which the conductors may be pressed between the contact terminals in a manner known per se (see for example EP 0 671 780) by way of ribs protruding into guide grooves of the base housing. Other connection techniques which are known to the man skilled in the art, such as plug connections of all types, are possible instead of the connection technology with connection blocks which is described here.

Of course the circuit board 104 apart from the connections between the contact locations and the contact elements, may yet contain further active and/or passive elements. They may further comprise several layers with strip conductors and lead-throughs between these, and/or a strip conductor guide for the compensation of crosstalk.

FIG. 15 shows a further example of a plug 61 of the type 1 in a view from below (with respect to the orientation according to FIG. 8). With regard to its function and its construction, the plug is analogous to the plug 61 described by way of FIGS. 8 and 9. In contrast to this however, the non-positive locking with the device according to the invention is solved in a different manner. The plug on the lower side—as also the previously described plug—comprises an incision 68 running in the axial direction, into which the security web 94 engages in the inserted condition. In contrast to the previously described embodiment, the locking lugs 65.2 on this incision 68 project inwards and lock behind the security web 94. As shown in FIG. 16, the security web then comprises a thickening 94 preferably towards the end on the socket side, behind which the locking is effected.

A further advantageous variant of the device according to the invention is described by way of FIGS. 17 and 18. According to this variant, the positioning pins 31.1 of the adapter outer part and the corresponding positioning holes 45 of the circuit board are not arranged symmetrically, in contrast to the previously described embodiment. By way of this, one ensures that the circuit board may not be applied around the protuberance of the adapter outer part 21 31.3 the wrong way round. As is evident in FIG. 17, the adapter inner part 32, despite this, may comprise a symmetrical or at least approximately symmetrical arrangement of respective holes, wherein then no corresponding positioning pin 31.1 and no corresponding guide hole 45 of the circuit board is present for one or more of the holes, and in the drawn arrangement it is the hole on the left. The symmetrical arrangement of the holes in the adapter inner part 31 has the advantage that the same resistance moment given a mechanical deformation, is present over the whole width of the part.

Moreover in contrast to FIG. 4, the contacts K7, K8 of the contact pair 7/8 is crossed in the embodiment of the circuit board 33 according to FIG. 18. This is advantageous if the polarities of the contacts are important. Generally, the contacts K1, K3, K5 and K7 are of the same polarity (polarity a). One succeeds in the contacts of the same polarity in each case coming to lie on the same side of the plug by way of the crossing of the contacts K7 and K8.

Figure 19:
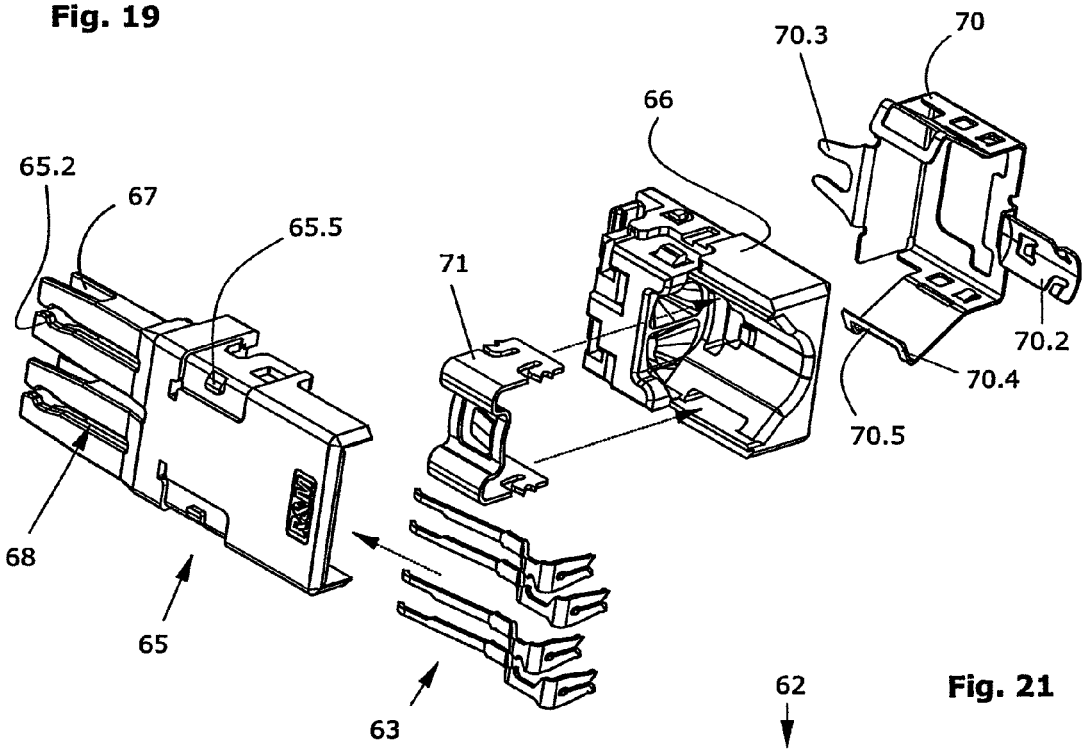
Figure 21:
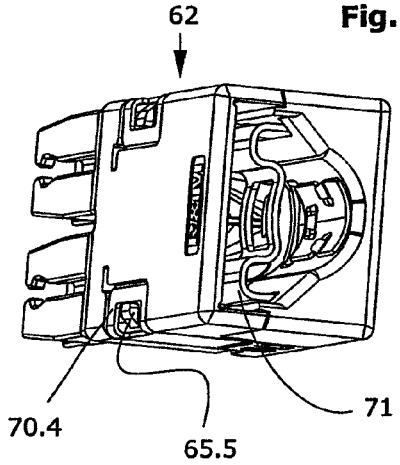
Figure 20:
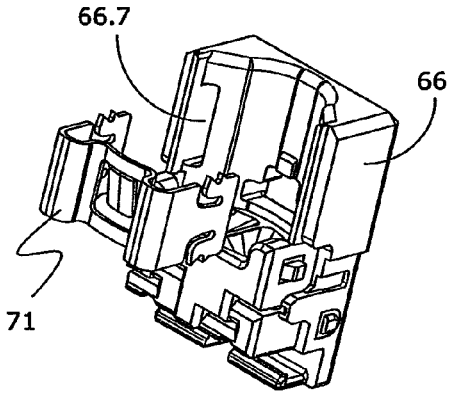
Figure 22:
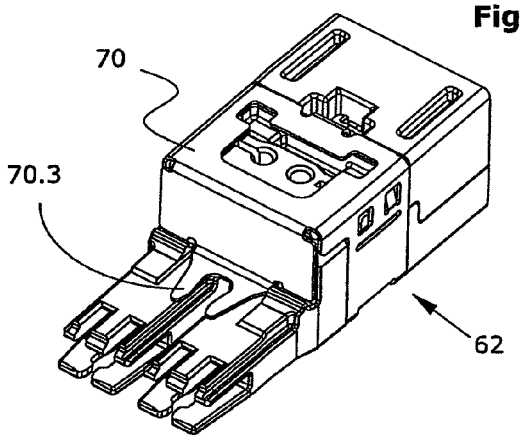

Further optional features of a plug are shown by way of the plug for four-core cables (double plug) shown in FIGS. 19-22. FIG. 19 shows an exploded representation of the plug, FIG. 20 the interaction of the pull relief element 71 with the plug attachment 66, and FIGS. 21 and 22 in each case show a view of the plug 62 from different sides.

Here to, the difference to the already described plug according to FIGS. 10 and 11 will be dealt with.

A metallic, resilient pull relief element 71 is present for pull relief, which may be locked into corresponding shaping formations 66.7 of the plug attachment 66 and which hooks into this thanks to barbs. An elasticity which is increased compared to plastic, is present due to the fact that the pull relief part is metallic. The metallic design moreover permits an infinite adaptation to the outer diameter of the cable to be wired (connection cable), which is not possible with the plastic design (locking steps).

The shielding 70 in contrast to the shielding shown in FIG. 11, has no first contact tongue 70.1, but a contact terminal 70.3 which in the inserted condition clamps around the separating wall and electrically contacts this in the manner of a fork contact.

The shielding in this embodiment simultaneously serves as a connection element between the plug base part 65 and the plug attachment 66. It snaps in by way of an undercut 70.4 on the plug base part 66, wherein a transverse web 70.5 of the undercut locks behind a locking projection (locking lug 65.5).

The man skilled in the art will recognise that many further embodiments within the context and spirit of the invention are possible.

The invention claimed is:

1. A device for connecting a plurality of plugs to a standardised electrical signal lead plug socket, the standardised electrical signal lead plug socket having a socket opening and a plurality of socket contacts lying bare in the inside of the socket opening, wherein at least four socket contacts arranged next to one another define a first direction, the device comprising:

a plug portion which can be inserted into the plug socket, wherein when the plug portion is inserted into the plug socket, a plurality of adapter contacts make an electrically conductive connection with socket contacts of the plug socket a plurality of chambers that are each smaller than the socket opening, into which chambers the plurality of plugs can be introduced simultaneously, wherein in each chamber, at least two of the adapter contacts can be electrically conductively contacted by plug contacts of the introduced plugs, wherein the chambers are designed and dimensioned such that at least a part of the plugs projects into the socket opening when the plugs are introduced simultaneously into the chambers, and wherein at least two of the chambers are distanced from one another in a direction which is different from the first direction.

2. A device according to claim 1, wherein when the device is inserted into the plug socket, and at least one plug is inserted into at least one chamber, said socket contacts and said plug contacts bear directly on the adapter contacts and wherein the adapter contacts are free of resilient sections.

3. A device according to claim 1, wherein the adapter contacts are formed by strip conductors of a flex-print.

4. A device according to claim 1, wherein the device contains precisely four chambers, wherein each of the chambers lies at one of the four corners of the socket.

5. A device according to claim 1, wherein separating walls comprise lateral limitations between the chambers and project up to the end-face of the device, which is on the plug side.

6. A device according to claim 1, wherein the chambers in a cross section perpendicular to an insert axis, have a rectangular shape with at least one projection projecting to the inside and/or a recess running to the outside.

7. A device according to claim 6, wherein the at least one projection and/or the at least one recess is designed equally at each of the chambers, so that the same plug may be inserted into each of the chambers.

8. A device according to claim 6, wherein the projections and/or recesses of at least two chambers are not identical, in a manner such that a mechanical coding results.

9. A device according to claim 1, wherein the device is designed and dimensioned such that it is suitable for connecting a plurality of plugs to a RJ45 plug socket.

10. A device according to claim 9, wherein the contact pairs 4/5 on the one hand and 3/6 on the other hand, of the RJ45 plug socket, are in electrical connection with adapter contacts, which are assigned to chambers which do not lie next to one another with respect to the first direction.

11. A device according to claim 1, wherein the device comprises an adapter outer part with the chambers and with a protuberance projecting into the inside of the socket, a flex-print which partly encloses the protuberance and on which the adapter contacts are designed as strip conductors, as well as an adapter inner part which is at least partly snapped around the flex-print and fixes the flex-print.

12. A device according to claim 1, wherein an electrically conductive connection is created between a shielding of the plug socket and a plug shielding.

13. A device according to claim 11, wherein the surface of the adapter outer part is electrically conductive, at least in regions.

14. A plug-and-socket system, comprising a device according to claim 1, as well as at least one plug with at least one plug portion which may be introduced into one of the chambers, and with at least two plug contacts which, in the introduced condition of the plug, contacts a contact location of the adapter contact.

15. A plug-and-socket system according to claim 14, wherein the plug contacts comprise a resilient section which, in the inserted condition of the plug, presses onto one of the adapter contacts.

16. A plug-and-socket system according to claim 14, wherein by way of the plug portion being inserted into one of the chambers, a slot which is open towards the chamber is formed, and a section of the plug contacts lies bare in this slot.

17. A device according to claim 1, wherein at least a portion of each of the plurality of chambers can be inserted into the plug socket.

18. A plug-and-socket distributor module, usable for a plug-and-socket system comprising a device for connecting a plurality of plugs to a standardised electrical signal lead plug socket with a socket opening and with a plurality of socket contacts lying bare in the inside of the socket opening, of which at least four socket contacts arranged next to one another define a first direction, comprising:

a plug portion which can be inserted into the plug socket, a plurality of adapter contacts, which, if the plug portion is inserted, are in electrically conductive connection with socket contacts of the plug socket, a plurality of chambers, into which the plugs can be introduced, wherein in each chamber, at least two of the adapter contacts can be electrically conductively contacted by plug contacts of the introduced plugs, wherein the chambers are designed and dimensioned such that at least a part of the plugs introduced into the chambers projects into the socket opening, and wherein at least two of the chambers are distanced from one another in a direction which is different from the first direction, the plug and socket system further comprising at least one plug with at least one plug portion which may be introduced into one of the chambers, and with at least two plug contacts which, in the introduced condition of the plug, contacts a contact location of the adapter contact, and the distributor module further comprising a front element with a plurality of plug openings arranged next to one another, as well as a circuit board with strip conductors and with an edge, along which the strip conductors form contact locations, wherein the circuit board is arranged relative to the front element (102), such that the contacts of plugs inserted into the plug openings electrically contact the contact locations.

19. A plug-and-socket distributor module according to claim 18, further comprising a device for connecting led signal leads, by way of which an electrical contact between the signal leads and the strip conductors may be created.

20. A plug-and-socket distributor module according to claim 18, wherein the plug openings are designed and are arranged relative to the circuit board, such that if the plugs are inserted, the end-side of the circuit board edge facing the plug opening, projects into a slot of the plugs, in which slot the plug contacts lie bare.

* * * * *